US005352034A

United States Patent [19]

Held et al.

[11] Patent Number: 5,352,034

[45] Date of Patent: Oct. 4, 1994

[54] HOLDING APPARATUS FOR REMOVABLY CONNECTING A DRAWER SIDE WALL TO A PULL-OUT RAIL

[75] Inventors: Wolfgang Held, Hard; Maximilian Mai, Feldkirch-Tisis, both of Austria

[73] Assignee: Julius Blum Gesellschaft m.b.H, Höchst, Austria

[21] Appl. No.: 15,363

[22] Filed: Feb. 3, 1993

Related U.S. Application Data

[62] Division of Ser. No. 644,733, Jan. 18, 1991, Pat. No. 5,222,791.

[30] Foreign Application Priority Data

Jan. 22, 1990 [AT] Austria ..... 124/90

[51] Int. Cl.[5] ..... A47B 95/00

[52] U.S. Cl. ..... 312/334.27; 312/334.1

[58] Field of Search ..... 312/334.1, 334.6, 334.27, 312/334.29, 334.31, 343.4

[56] References Cited

U.S. PATENT DOCUMENTS 3,207,565 9/1965 Scharge .
3,752,553 8/1973 Bildahl et al. .
4,846,538 7/1989 Röck et al. .
4,850,659 7/1989 Röck et al. .

FOREIGN PATENT DOCUMENTS 322140 5/1975 Austria .
0041616 12/1981 European Pat. Off. .
0291781 11/1988 European Pat. Off. .
3120555 6/1982 Fed. Rep. of Germany .
2759349 7/1983 Fed. Rep. of Germany .
8802690 5/1988 Fed. Rep. of Germany .
3801816 8/1988 Fed. Rep. of Germany .
2569093 2/1986 France .
2604876 4/1988 France .
1185585 3/1970 United Kingdom .

*Primary Examiner*—Kenneth J. Dorner
*Assistant Examiner*—Gerald A. Anderson
*Attorney, Agent, or Firm*—Wenderoth, Lind & Ponack

[57] ABSTRACT

A securing apparatus (5) for the front panel (1) of a drawer. Securable to the front panel (1) are hook-type holding parts (6) which when the front panel (1) is mounted are suspendable in carrier parts (21) associated with the drawer side walls (2) and may be braced by these carrier parts. Provided on each side of the drawer is a housing (5') which may be secured by means of dowel (15) or the like to a side wall (2) of the drawer, preferably made of wood material, for example a chipboard, and this housing being mounted in a carrier part (21). Furthermore, a removable holding apparatus (50) for a draw-out rail (14), secured to the drawer, of a draw-out guide fitting is provided, with the draw-out rail (14) having at the rear a hook (40) by means of which it is suspendable in the drawer and having at the front an open horizontal slit (11) into which a laterally projecting holding peg (13) of the holding apparatus (50) projects. A locking peg (9) which is displaceable perpendicular to the draw-out rail (14) and which is preferably acted upon by a pressure spring (28) is movable by means of a vertically movable unlocking rod (30) out of the draw-out rail. (FIG. 3 )

27 Claims, 9 Drawing Sheets

HOLDING APPARATUS FOR REMOVABLY CONNECTING A DRAWER SIDE WALL TO A PULL-OUT RAIL

Figure 1:
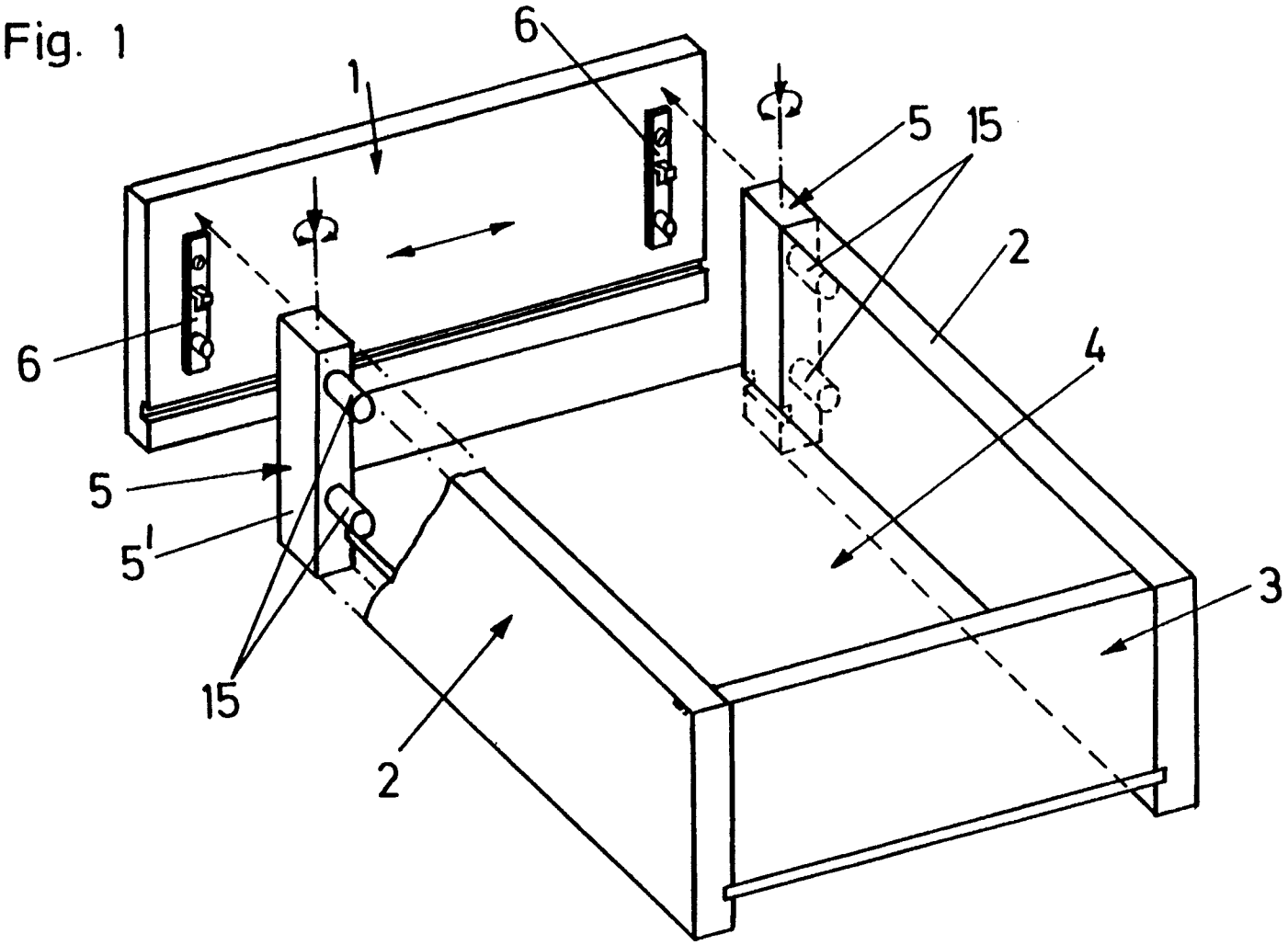

This is a division of Ser. No. 07/644,733, filed Jan. 18, 1991, now U.S. Pat. No. 5,222,791.

The invention relates to a securing apparatus for the front panel of a drawer, there being securable to the front panel hook-type holding parts which when the front panel is mounted are suspendable in carrier parts associated with the drawer side walls and may be braced by these carrier parts, there being provided on each side of the drawer a housing which may be secured by means of dowel or the like to a side wall of the drawer, made of wood material, for example a chipboard, and this housing being mounted in a carrier part.

The invention furthermore relates to a removable holding apparatus for a draw-out rail, secured to the drawer, of a draw-out guide fitting, with the draw-out rail having at the rear a hook by means of which it is suspendable in the drawer and having at the front an open horizontal slit into which a laterally projecting holding peg of the drawer or of the holding apparatus projects.

Various securing apparatuses for the front panel of a drawer are known, differing principally according to whether the drawer side walls are made of plastics material or of metal. With drawer frames of metal, the front panel is usually suspended by means of a holding part directly in the drawer frames or is connected thereto; this means that the actual carrier part of the securing apparatus for the front panel is part of the drawer frame. However, if the drawer side walls are made of plastics, then the draw-out rails of the draw-out guide fitting of the drawer are provided at their front ends with angular carrier parts in which the holding parts of the securing apparatus for the front panel are suspendable.

Front panels of wooden drawers, in accordance with the known prior art, are dowelled to the side walls of the drawer, which means that a subsequent adjustment of the front panel is not possible.

It is the object of the invention to provide a securing apparatus of the type mentioned at the outset, which is in particular suitable for anchoring a front panel and subsequent positioning of a front panel on a drawer having side walls of wood.

In accordance with the invention, this is achieved in that the carrier part, which as seen from the front is constructed in a U shape with lateral flanges, receives a latching-in part which is U-shaped in plan view, is height-displaceable and is acted upon by a spring, and in that the carrier part may be tilted about a horizontal axis by means of a screw arranged perpendicularly in the housing and held in the housing rotatably but axially undisplaceably.

A further object of the invention is to provide a removable holding apparatus for a draw-out rail which is secured to the drawer and which may be mounted together with the securing apparatus for the front panel on the drawer side wall and which, like the clamping means of the securing apparatus for the front panel, may be actuated from above.

This is achieved by a locking peg which is displaceable perpendicular to the draw-out rail and which is preferably acted upon by a pressure spring and which projects into an opening in the draw-out rail and which, by means of a vertically movable unlocking rod which is held in an upper end position by a pressure spring, is movable out of the draw-out rail, with the unlocking rod bearing by means of a wedge surface or edge against a stop of the locking peg.

Example embodiments of the invention will be described below with reference to the figures in the attached drawings.

Figure 2:
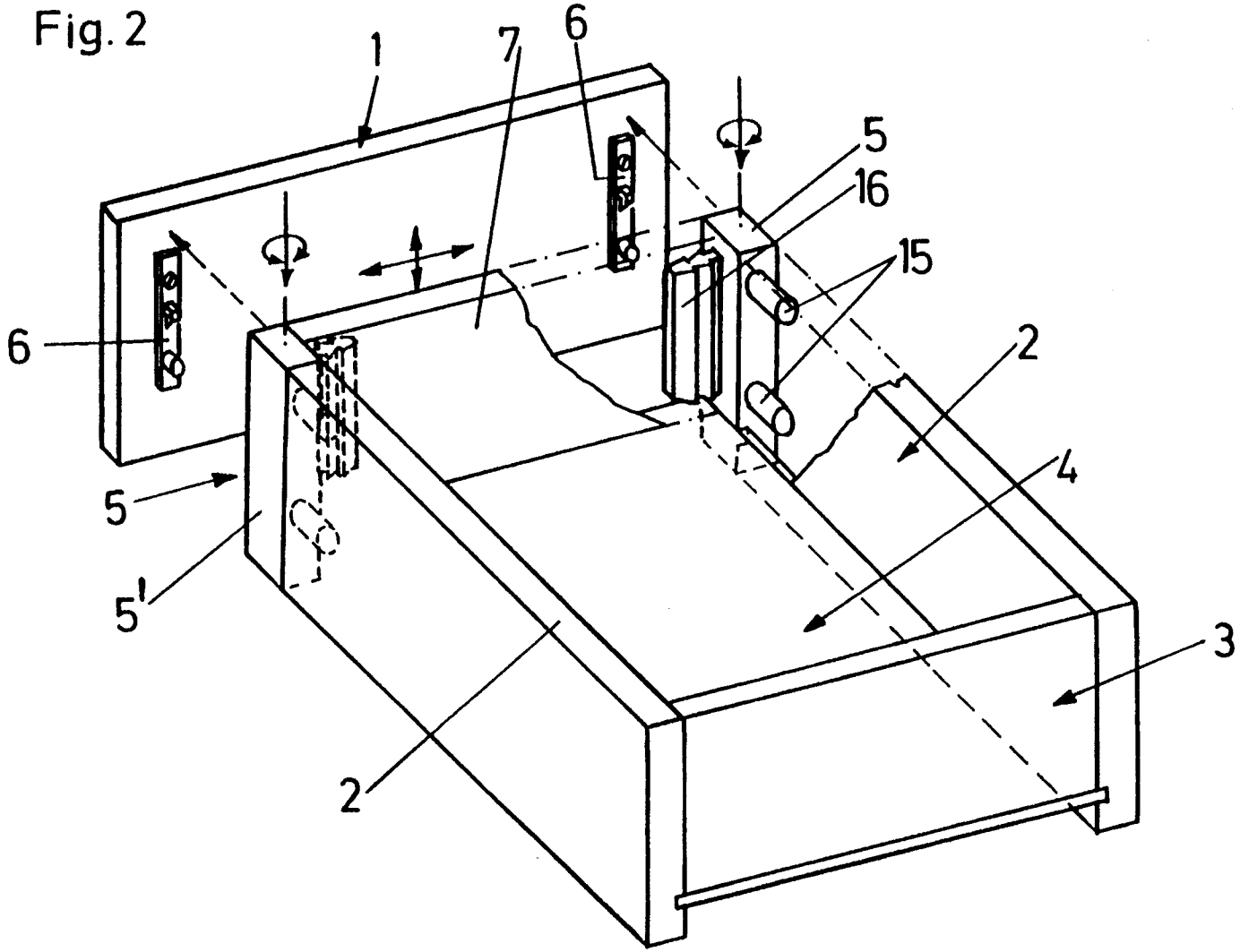
Figures 3, 3A:
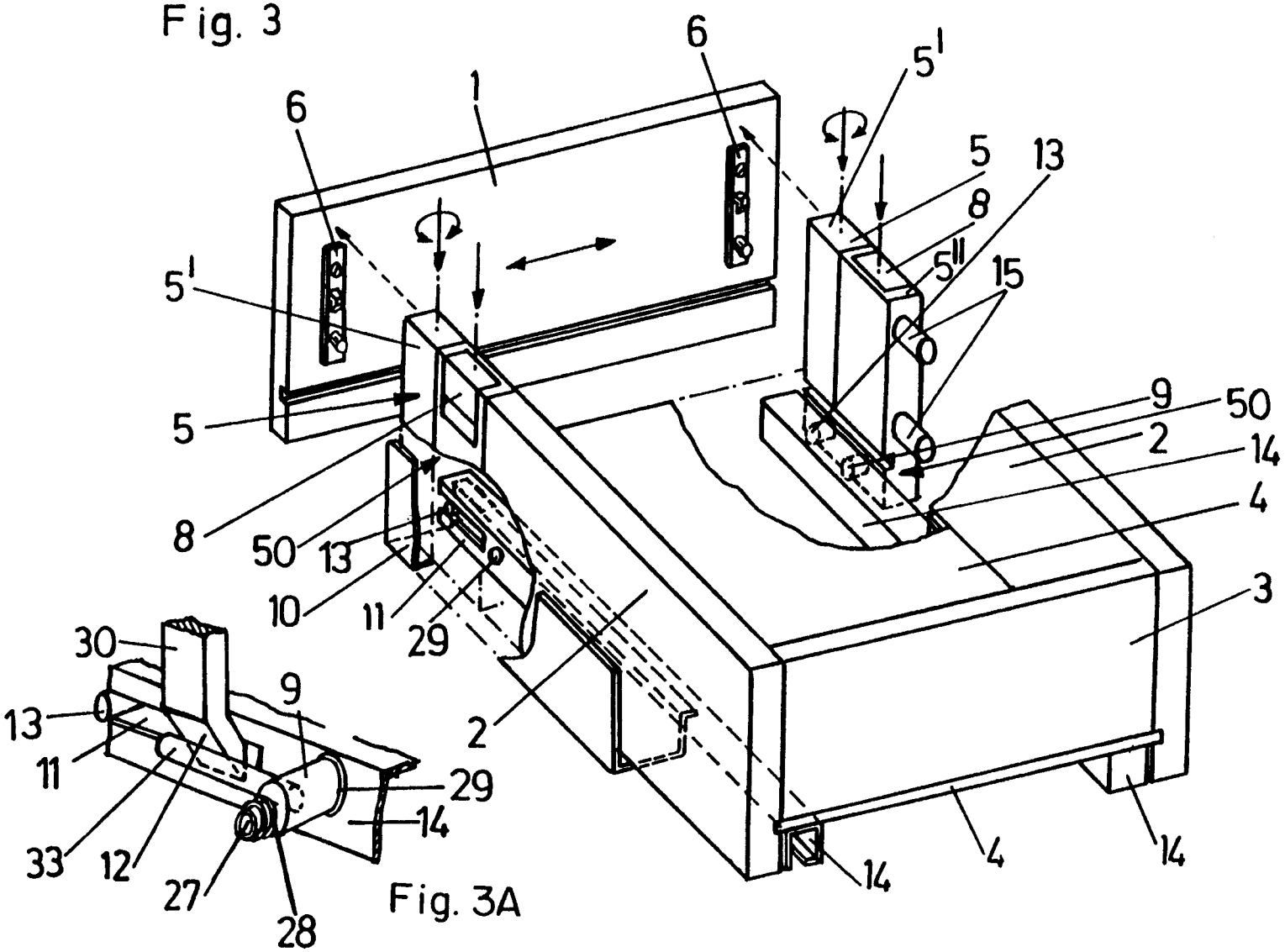
Figure 4:
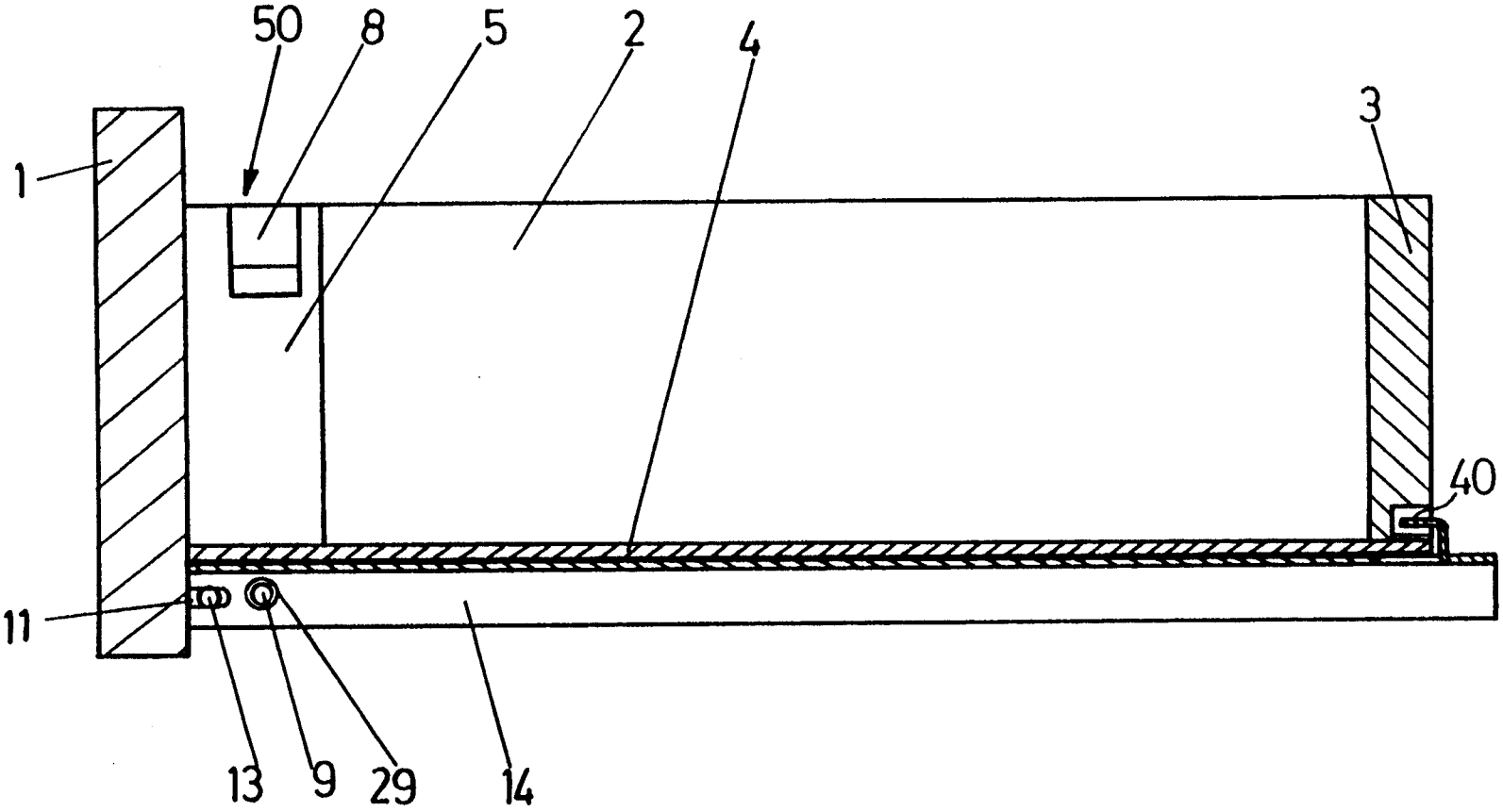
Figure 5:
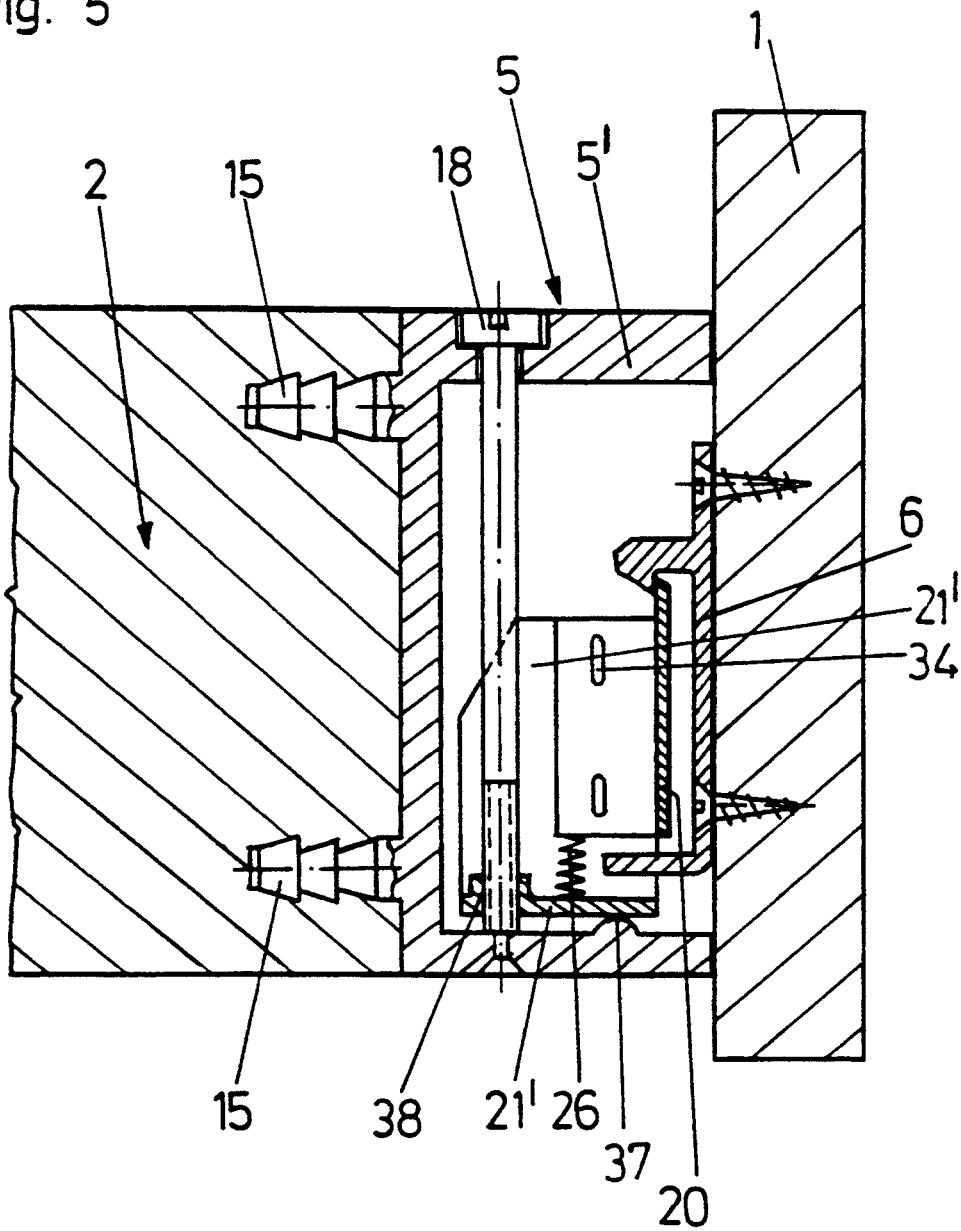
Figure 6:
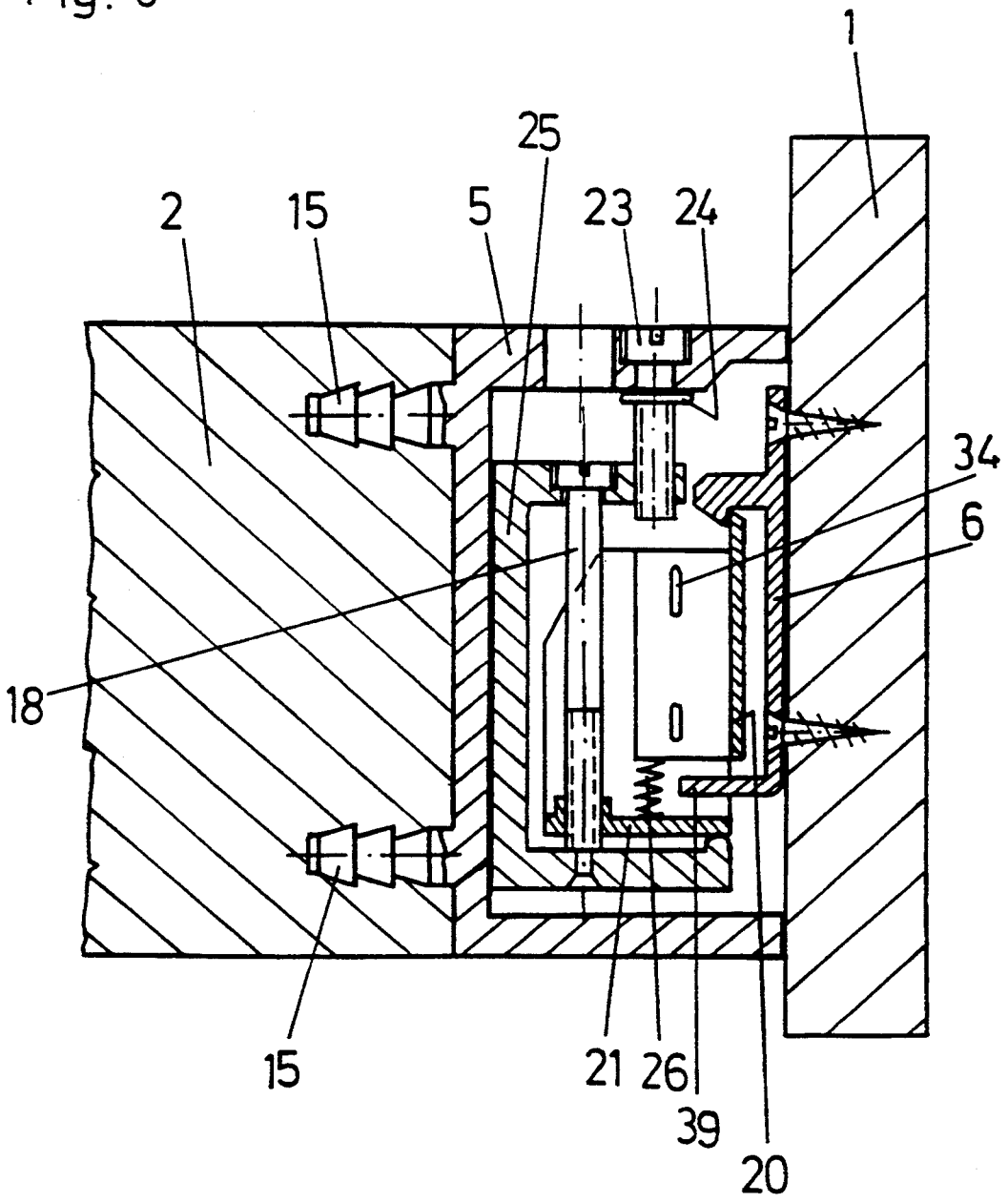
Figure 7:
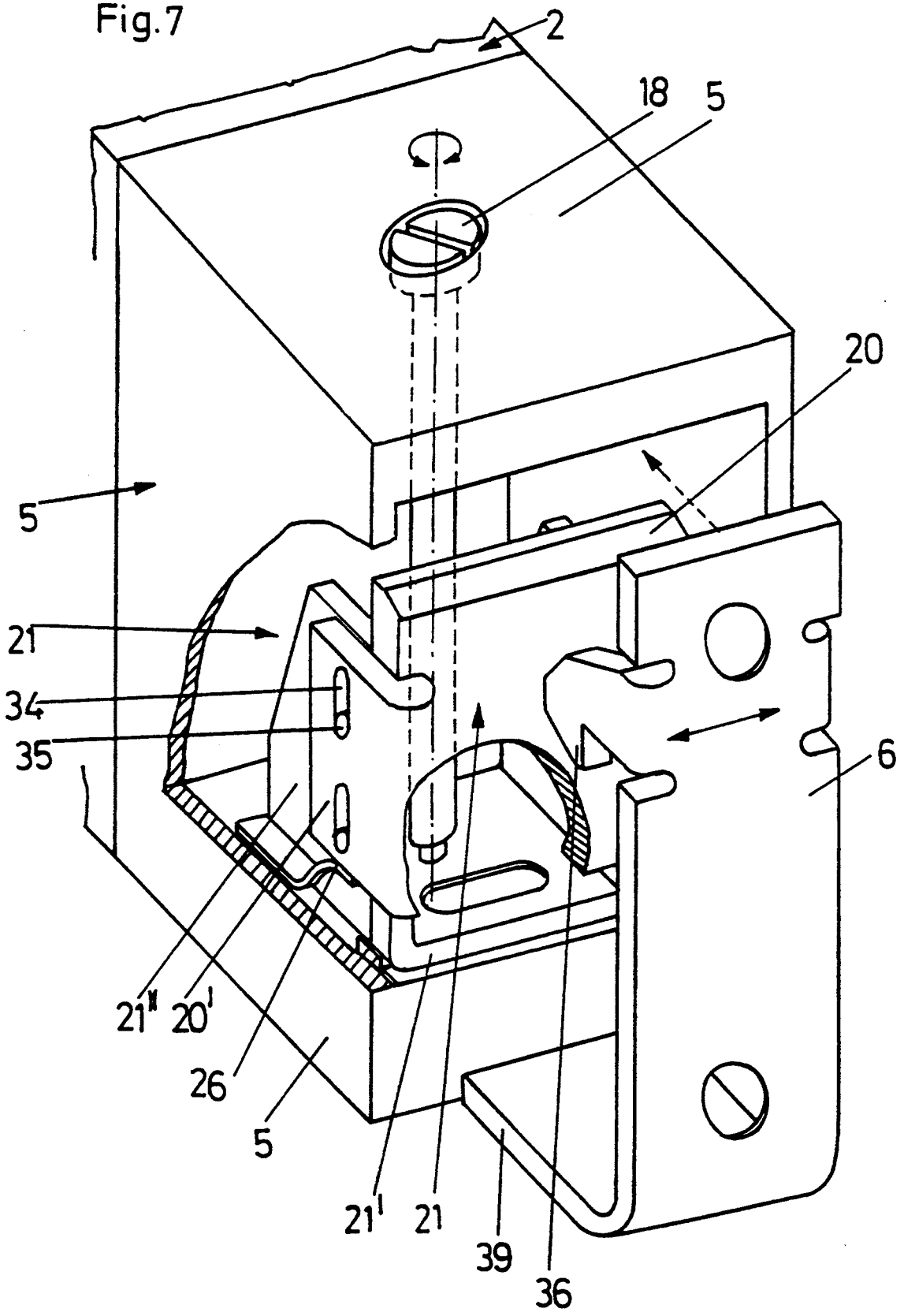
Figure 8:
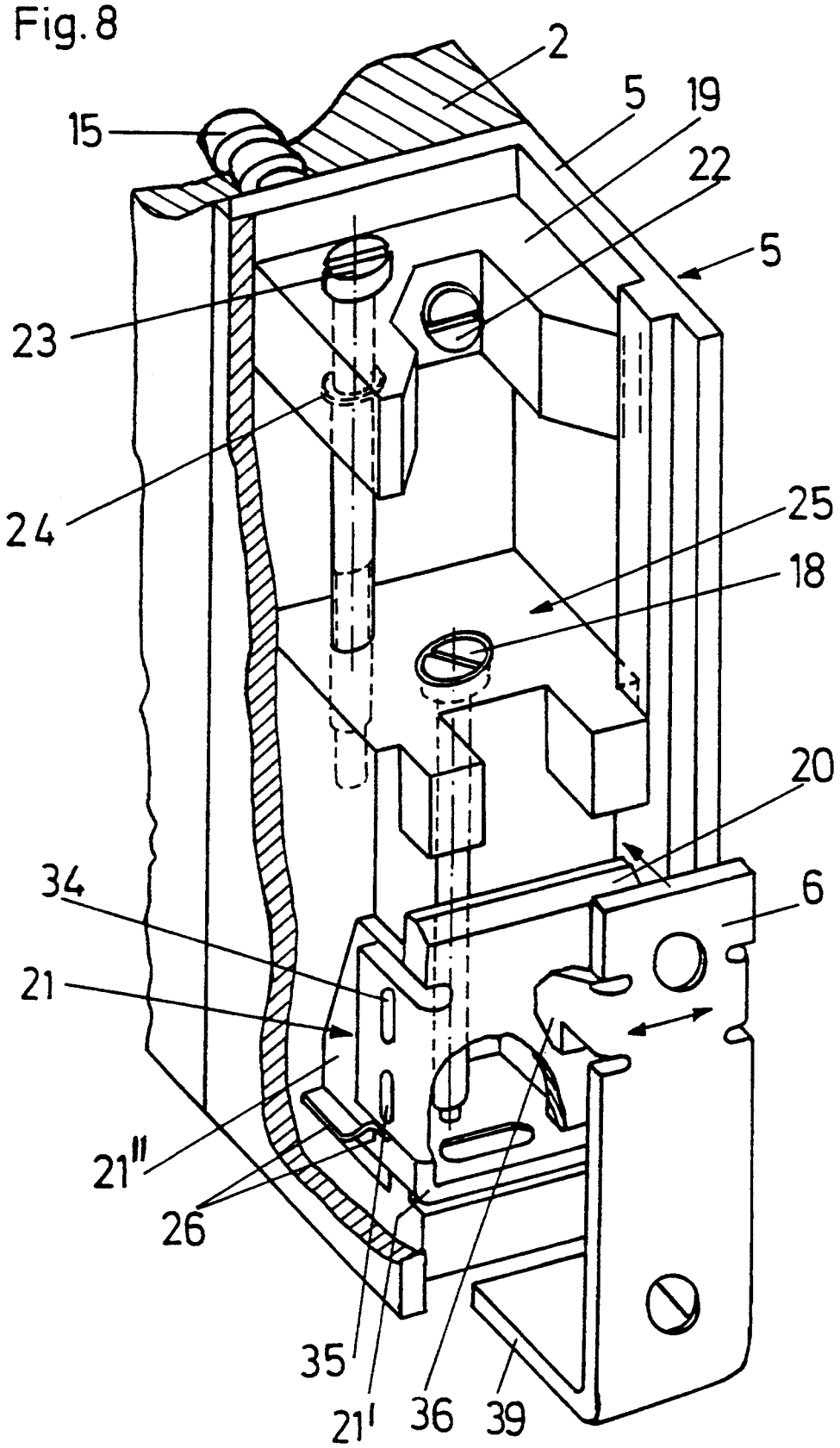
Figure 9:
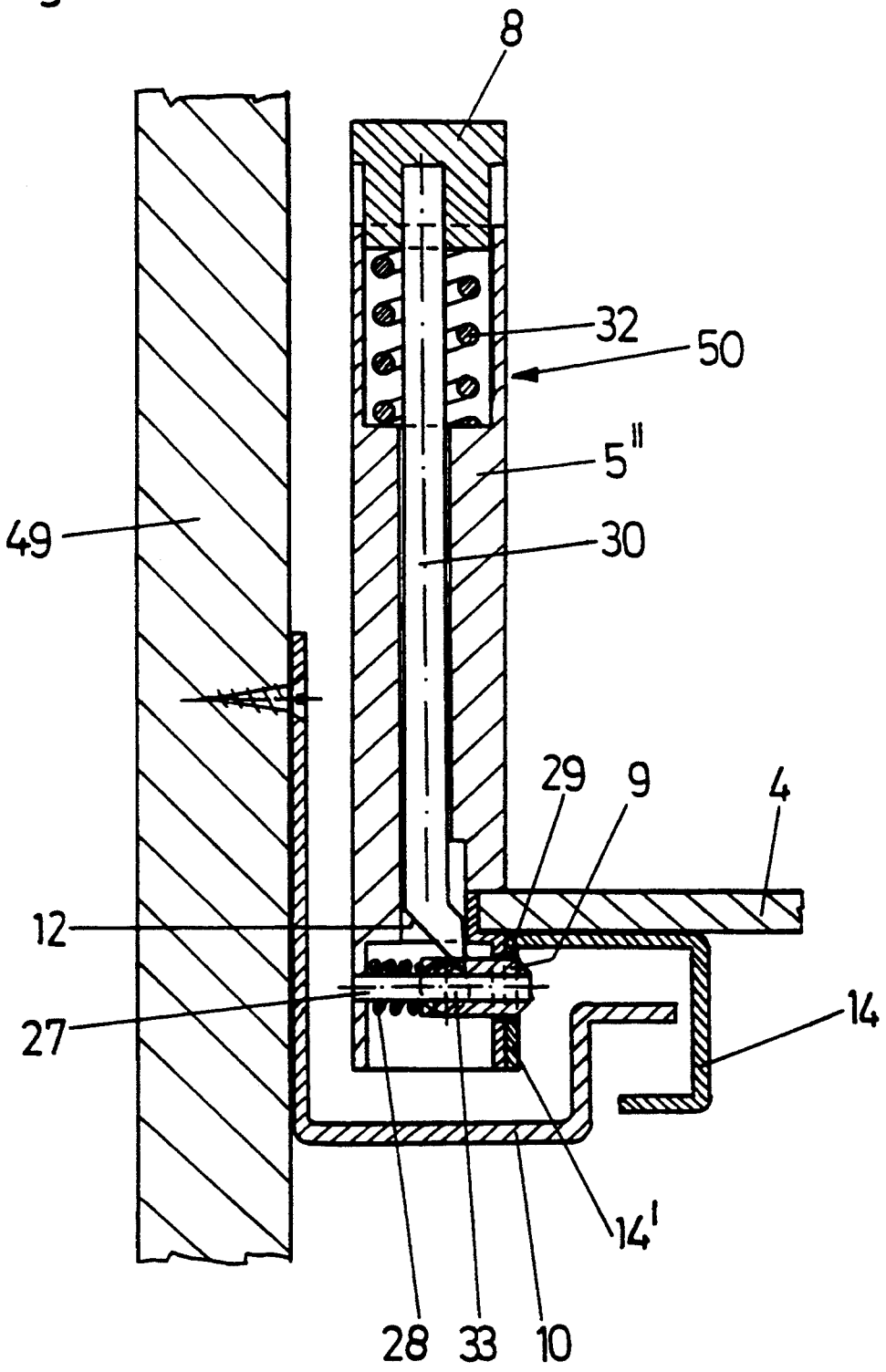

FIG. 1 and FIG. 2 each show a diagram of a drawer having a securing apparatus according to the invention; FIG. 3 shows a diagram of a drawer having a front plate securing apparatus according to the invention and removable holding apparatuses for the draw-out rail; FIG. 4 shows a side view of a drawer having a removable holding apparatus for a draw-out rail; FIGS. 5 and 6 each show a vertical section perpendicular to the drawer front panel through two different example embodiments of a front panel securing means according to the invention; FIGS. 7 and 8 each show a diagram, partially cut away, of these example embodiments of a front panel securing means according to the invention; and FIG. 9 shows a vertical section parallel to the drawer front panel through a removable holding apparatus for the draw-out rail.

In conventional manner, the draw comprises the two drawer side walls 2, the drawer rear wall 3, the drawer base 4 and the front panel 1. The drawer side walls 2 are made of wood, a chipboard or the like.

In addition to the front panel 1, as can be seen from FIG. 2, the drawer may also be provided with a front plate 7 which connects-the two side walls 2 to one another via the securing apparatuses 5 for the front panel 1.

The securing apparatuses 5 are secured to the end sides of the drawer side walls 2 by means of dowels 15. Instead of the dowels 15, a dowel strip 16 could equally be provided, as shown in FIG. 2 as securing means for securing apparatus 5 and front plate 7.

The simpler form of the front panel securing means 5, which only allows an adjustment of the front panel 1 to the side, is shown in FIGS. 5 and 7.

Each securing apparatus 5 has a housing 5' which is dowelled directly to the drawer side wall 2 and which extends the drawer side wall 2 virtually as far as the front panel 1 and thus preferably has the same height and width as the drawer side wall 2.

The carrier part 21 is mounted within the housing 5'. The carrier part 21 is in two parts and has a carrier part body 21' and an insert part 20 in which the holding part 6, secured to the front panel 1 by means of screws or the like, is directly suspendable.

As may be seen from FIGS. 5 and 7, the carrier part body 21' of the carrier part 21 is, as seen from the front, U-shaped with lateral flanges 21'', and the latching-in part 20 is, as seen in plan view, U-shaped with lateral flanges 20'. The latching-in part 20 has lateral vertical slits 34 into which there project guides pegs 35 which are secured to the side flanges 21'' of the carrier part body 21'. The latching-in part 20 surrounds, with its flanges 20', the carrier part body 21' of the carrier part 21 and its flange 21'' and is held in its upper position by a spring 26, it being possible to press it downwards over the length of the slit 34. This makes possible suspension of the front panel 1 where the drawer is pushed into the carcass, since the front panel 1 may be pushed, below the already mounted front panel 1 of a drawer located above, or below a projecting edge of the upper base, into the front panel securing means 5 exactly at the height at which it is subsequently to be held. The length of the slit 34 must therefore be at least as long as the height of the hooks 36 of the holding parts 6.

Once the front panel 1 is in the suspended position with the holding parts 6, the screw 18 is turned.

As can be seen in particular from FIG. 5, the carrier part 21 lies on a cam 37 in the housing 5' of the front plate securing means 5. The screw 18 projects through a female thread 38 in the lower plate of the carrier part 21.

Since the screw 18 is held axially undisplaceably in the housing 5' of the securing apparatus 5, when the screw 18 is turned the carrier part 21 is tilted about the cam 37. If the screw 18 is turned such that the carrier part 21 is tilted backwards, that is to say away from the front panel 1, then the holding part 6 is braced by the carrier part 21.

The holding parts 6 furthermore have a lower horizontally projecting stop part 39 which projects between the two side webs 21'' of the carrier part body 21' and which, when it bears against one of these side webs 21'', forms a limiting stop for the possibility of lateral displacement of the front panel 1.

In the example embodiment of FIGS. 6 and 9, there is arranged in the housing 5' a vertically displaceable cage 25. In the cage 25 there are located again the carrier part 21 with the carrier part body 21' and the latching-in part 20. The front panel 1 is mounted as in the previous example embodiment by suspending the front panel 1 with the holding parts 6 in the latching-in parts 20 and by bracing the carrier part 21 by means of the screw 18.

By means of the screw 23, which is mounted in a frame 19 secured in the housing 5' by means of a screw 22 and which projects into a female thread in the cage 25, the cage 25 may be moved upwards or downwards; this means that the height of the front panel 1 may be adjusted. The screw 23 has a projecting edge 24 which may however also be formed from a Seeger ring or the like and which secures the screw 23 in the housing 5'.

As can be seen from FIG. 3, it is possible for the removable holding apparatus for the draw-out rail 14 of the drawer to be provided directly behind the securing apparatus 5, preferably in a housing part 5'' associated therewith.

The drawer 14 is provided at the rear with a hook 40 by means of which it can be anchored in the drawer rear wall 3.

At the front, the draw-out rail 14 has a slit 11 open to the front, through which there projects a locking peg 13 projecting from the drawer or the holding apparatus 50 laterally into the draw-out rail 14.

In order to remove the draw-out rail 14 from the drawer, it must be withdrawn at the rear from the drawer out of its anchoring (pin 13, hole for hook 40). This hinders a locking peg 9 which in the not, hal condition projects through a corresponding hole 29 in the draw-out rail 14 and which is displaceable in the holding apparatus 50 horizontally in a plane parallel to the front panel 1.

In this case, the locking peg 9 is mounted on a carrier peg 27 and is pressed outwards by a helical spring 28, i.e. into the vertical web 14' of the draw-out rail 14.

The locking peg 9 has a stop 33 which is formed for example from a laterally projecting cylindrical edge. Bearing against this stop 33 by means of a wedge surface 12 is an unlocking rod 30 arranged vertically in the housing 5''. The unlocking rod 30 is mounted at its upper end in a pushbutton-type part 8 and is held in its upper position by a helical spring 32. In this upper position of the unlocking rod 30, the draw-out rail 14 is locked.

If pressure on the button-shaped part 8 now moves the unlocking rod 30 downwards, then the wedge surface 12 of the unlocking rod 30 presses the locking peg 9 laterally outwards via the stop 33, i.e. to the side wall 49 of the carcass and thus out of the draw-out rail 14. It is now possible for the draw-out rail to be withdrawn freely backwards out of its anchoring with the drawer.

In FIGS. 3 and 9, the carrier rail on the carcass side is also drawn in and is given the reference numeral 10.

What is claimed is:

1. A holding apparatus for use on each of opposite sides of a drawer for removably connecting the drawer to a pull-out rail of a pull-out guide fitting on the respective side of the drawer, wherein the pull-out rail and drawer are relatively movable in opposite directions between a connected position and a released position, said apparatus comprising:

a holding member to be mounted on the drawer for movement in opposite directions toward and away from the pull-out rail between a locking position, whereat said holding member engages the pull-out rail and prevents movement of the pull-out rail from the connected position thereof, and an unlocked position, whereat said holding member is disengaged from the pull-out rail to enable movement to the released position thereof; and an unlocking member to be mounted on the drawer for movement in opposite directions away from and toward said holding member between a first position, whereat said holding member is maintained in said locking position thereof, and a second position, whereat said unlocking member moves said holding member to said unlocked position thereof.

2. An apparatus as claimed in claim 1, further comprising a lateral holding peg to be mounted on the drawer to extend into a slit formed in a forward end of the pull-out rail, thereby to suspend the drawer from the pull-out rail.

3. An apparatus as claimed in claim 1, wherein said holding member comprises a locking peg to project, in said locking position, into a hold formed in the pull-out rail.

4. An apparatus as claimed in claim 3, further comprising a spring acting on said locking peg to urge said locking peg in a direction to be toward the pull-out rail.

5. An apparatus as claimed in claim 4, wherein said locking peg and said spring are mounted for movement on a carrier peg, and said spring comprises a helical pressure spring.

6. An apparatus as claimed in claim 3, wherein said unlocking member comprises a rod having a first end to act on said holding member and a second end.

7. An apparatus as claimed in claim 6, wherein said locking peg has projecting laterally therefrom a stop, and said first end of said rod abuts said stop when said rod is moved to said second position.

8. An apparatus as claimed in claim 7, wherein said first end of said rod comprises a wedge surface.

9. An apparatus as claimed in claim 6, further comprising a spring urging said rod to said first position.

10. An apparatus as claimed in claim 8, further comprising a button member on said second end of said rod and by which said rod is movable against the force of said spring to said second position.

11. An apparatus as claimed in claim 1, wherein said holding member and said unlocking member are mounted in a housing to be incorporated into a respective side wall of the drawer.

12. An apparatus as claimed in claim 1, wherein said opposite directions of movement of said holding member are orthogonal to said opposite directions of movement of said unlocking member.

13. An assembly comprising:

a longitudinal pull-out rail to be employed as part of a pull-out guide fitting for use on each of opposite sides of a drawer to enable sliding movement of the drawer into and out of a furniture frame, said pull-out rail having adjacent opposite longitudinal ends thereof connecting structure to enable, upon relative movement in opposite first and second directions between said pull-out rail and the drawer, connection of said pull-out rail to the drawer in a connected position of said pull-out rail and disconnection of said pull-out rail from the drawer at a released position of said pull-out rail;

a holding member to be mounted on the drawer for movement in opposite directions toward and away from said pull-out rail between a locking position, whereat said holding member engages said pull-out rail and prevents movement of said pull-out rail from said connected position thereof, and an unlocked position, whereat said holding member is disengaged from said pull-out rail to enable movement to said released position thereof; and an unlocking member to be mounted on the drawer for movement in opposite directions away from and toward said holding member between a first position, whereat said holding member is maintained in said locking position thereof, and a second position, whereat said unlocking member moves said holding member to said unlocked position thereof.

14. An assembly as claimed in claim 13, wherein said connecting structure at a front end of said pull-out rail comprises a forwardly open longitudinal slit formed in said front end, and a lateral holding peg to be mounted on the drawer to extend therefrom and to project into said slit.

15. An assembly as claimed in claim 13, wherein said opposite first and second directions are longitudinally of said pull-out rail.

16. An assembly as claimed in claim 13, wherein said holding member comprises a locking peg projecting, in said locking position, into a hole formed in said pull-out rail.

17. An assembly as claimed in claim 16, further comprising a spring acting on said locking peg to urge said locking peg toward said pull-out rail.

18. An assembly as claimed in claim 17, wherein said locking peg and said spring are mounted for movement on a carrier peg, and said spring comprises a helical pressure spring.

19. An assembly as claimed in claim 16, wherein said unlocking member comprises a rod having a first end to act on said holding member and a second end.

20. An assembly as claimed in claim 19, wherein said locking peg has projecting laterally therefrom a stop, and said first end of said rod abuts said stop when said rod is moved to said second position.

21. An assembly as claimed in claim 20, wherein said first end of said rod comprises a wedge surface.

22. An assembly as claimed in claim 19, further comprising a spring urging said rod to said first position.

23. An assembly as claimed in claim 22, further comprising a button member on said second end of said rod and by which said rod is movable against the force of said spring to said second position.

24. An assembly as claimed in claim 13, wherein said holding member and said unlocking member are mounted in a housing to be incorporated into a side wall of the drawer.

25. An assembly as claimed in claim 13, wherein said opposite directions of movement of said holding member are orthogonal to said opposite directions of movement of said unlocking member.

26. An assembly as claimed in claim 13, wherein said connecting structure at a rear end of said pull-out rail comprises a hook to be suspended from the drawer in said connected position.

27. An assembly as claimed in claim 26, wherein said connecting structure at a front end of said pull-out rail comprises a forwardly open longitudinal slit formed in said front end, and a lateral holding peg to be mounted on the drawer to extend therefrom and to project into said slit.

* * * * *